US011401951B2

(12) United States Patent
Karstadt et al.

(10) Patent No.: US 11,401,951 B2
(45) Date of Patent: Aug. 2, 2022

(54) COMPRESSOR HAVING ADJUSTMENT MECHANISM

(71) Applicant: BorgWarner Inc., Auburn Hills, MI (US)

(72) Inventors: Sascha Karstadt, Undenheim (DE); Jason Walkingshaw, Heidelberg (DE); Ahmet Coksen, Mannheim (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/155,287

(22) Filed: Jan. 22, 2021

(65) Prior Publication Data

US 2021/0239134 A1 Aug. 5, 2021

(30) Foreign Application Priority Data

Feb. 3, 2020 (DE) ..... 102020102640.4

(51) Int. Cl.

| | |
|---|---|
| ***F04D 29/66*** | (2006.01) |
| ***F04D 29/42*** | (2006.01) |
| ***F04D 29/053*** | (2006.01) |
| *F02B 37/10* | (2006.01) |

(52) U.S. Cl.

CPC ..... *F04D 29/667* (2013.01); *F04D 29/053* (2013.01); *F04D 29/4206* (2013.01); *F02B 37/10* (2013.01)

(58) Field of Classification Search

CPC ..... F04D 29/667; F04D 29/4206; F04D 29/4213; F04D 37/225; F04D 29/464; F02B 37/225

See application file for complete search history.

(56) References Cited

U.S. PATENT DOCUMENTS

2019/0178151 A1* 6/2019 Smith ..... F02B 33/40
2019/0338699 A1* 11/2019 Mohtar ..... F04D 27/0246

* cited by examiner

*Primary Examiner* — Sabbir Hasan
(74) *Attorney, Agent, or Firm* — Howard & Howard Attorneys PLLC

(57) ABSTRACT

A compressor for a charging device, and a charging device having a corresponding compressor. The compressor comprises a compressor housing having a compressor inlet and a compressor outlet, and a compressor wheel and an adjustment mechanism. The compressor wheel is arranged in the compressor housing and can be rotated along a compressor axis. The adjustment mechanism is arranged in front of the compressor wheel axially in the current direction and can be adjusted between a first position and a second position in order to change an inlet cross-section of the compressor inlet. As a result of the adjustability of the adjustment mechanism, the inlet cross-section can be changed between a maximum inlet cross-section and a reduced inlet cross-section. Here, the adjustment mechanism forms the reduced inlet cross-section in such a way that the reduced inlet cross-section is arranged eccentrically in relation to the compressor axis.

20 Claims, 6 Drawing Sheets

COMPRESSOR HAVING ADJUSTMENT MECHANISM

CROSS-REFERENCE TO RELATED APPLICATIONS

This application claims priority pursuant to 35 U.S.C. 119(a) of German Patent Application No. 102020102640.4, filed Feb. 3, 2020, which application is incorporated herein by reference in its entirety.

TECHNICAL FIELD

The present invention relates to a compressor having an adjustment mechanism. Furthermore, the invention relates to a charging device having such a compressor.

BACKGROUND

More and more vehicles of more recent generations are equipped with charging devices in order to achieve demand targets and legal requirements. When developing charging devices, it is important to optimise both the individual components and the system as a whole in terms of their reliability and efficiency.

Known charging devices often have at least one compressor having a compressor wheel which is connected to a drive unit via a common shaft. The compressor compresses the fresh air suctioned for the internal combustion engine or for the fuel cell. Thus, the amount of air or oxygen which the engine has available for combustion or the fuel cell has available for the reaction increases. In turn, this leads to a power increase of the internal combustion engine or the fuel cell. Charging devices can be equipped with various drive units. In particular, E-chargers in which the compressor is driven via an electric engine and exhaust gas turbochargers in which the compressor is driven via an electric engine are known in the prior art. Combinations of the two systems are also described in the prior art.

Each compressor has a compressor-specific compressor characteristic map, wherein the operation of the compressor is limited to the region of the compressor characteristic map between the surge limit and the choke limit. On the compressor characteristic map, the enforced volume flow on the x-axis is compared with the pressure ratio between compressor inlet and outlet on the y-axis. Furthermore, curved lines for different rotational speeds are plotted up to the maximum permissible rotational speed between the surge limit and the choke limit. Depending on the size and shape of the compressor, the operation with low volume flows through the compressor within the compressor characteristic map may be less efficient. If the surge limit is not reached, the operation is no longer possible in an operatively safe manner. This means that the surge limit limits the compressor characteristic map to the left, the surge limit does so to the right.

Various measures are known in the prior art for optimising the compressor characteristic map. In particular, these are adjustment mechanisms, which are arranged in front of the compressor wheel in the current direction in the inlet region of the compressor, and housing adaptations in the compressor inlet wall for modifying the current. As a result of the adjustment mechanisms, the current cross-section in the compressor inlet can be varied, whereby the inflow speed and the volume flow can be set to the compressor wheel. These adjustment mechanisms can be formed in different ways and can, for example, comprise several aperture elements pivotable in the compressor inlet, lamella-like trimming elements having a funnel-shaped cross-sectional border, for example, axially shiftable sleeves, radially moveable or extendable wall elements. In particular, so-called "ported shrouds" (e.g. recirculation channels) rank among the adaptations in the compressor inlet wall. Both kinds of current modification devices are effective as measures for extending or stabilising the characteristic map, whereby, in turn, the instabilities of the compressor in the operating points relevant to the operation are reduced. A further possibility for improving the efficiency and lowering the emission values of the internal combustion engine can be obtained as a result of a reduction of the nitrogen oxide emission. Known current modification devices, in particular adjustment mechanisms, lead to an impact on the current conditions in the compressor which often lead to unfavourable behaviour of the compressor in terms of noise, vibration and harshness (NVH behaviour).

The object of the present invention is to provide a compressor having an improved current modification device in terms of NVH behaviour.

SUMMARY OF THE INVENTION

The present invention relates to a compressor according to claim 1. Furthermore, the invention relates to a charging device having such a compressor according to claim 15.

The compressor according to the invention for a charging device comprises a compressor housing, a compressor wheel and an adjustment device. The compressor housing has a compressor inlet having an inlet cross-section and a compressor outlet. The compressor wheel is arranged in the compressor housing and rotatably mounted along a compressor axis. The adjustment mechanism is arranged in front of the compressor wheel axially in the current direction. Furthermore, the adjustment mechanism can be shifted between a first position and a second position in order to change the inlet cross-section, such that the inlet cross-section can be changed between a maximum inlet cross-section and a reduced inlet cross-section. Here, the adjustment mechanism forms the reduced inlet cross-section, such that the reduced inlet cross-section is arranged eccentrically in relation to the compressor axis. As a result of the eccentric arrangement of the reduced inlet cross-section, current vortices emerging on a rear side (in the current direction) or an inner edge (radially inner edge) of the adjustment mechanism between the adjustment mechanism and the compressor wheel interact eccentrically with the compressor wheel. The eccentricity changes the strength and the detachment frequency of the current vortices in the peripheral direction and influences the frequency spectrum in a favourable manner. Thus, a more broadband noise development can be generated which can be perceived less intensively. As a result, the NVH behaviour can thus be improved.

In a design of the compressor, the adjustment mechanism can comprise a plurality of aperture elements. The aperture elements can be arranged around an aperture axis in the peripheral direction. Here, the aperture axis is spaced apart from the compressor axis by an eccentricity E. In addition, the eccentricity E can assume a value of between 1% and 100%, preferably between 25% and 95%, and particularly preferably between 50% and 90% of a maximum possible eccentricity $E_{max}$.

In designs of the compressor that can be combined with any of the previous designs, in each case one bearing bore can be provided in the compressor housing or in a bearing ring for each aperture element. Here, the bearing bores can be arranged around the aperture axis along a bolt circle. In other words, this means that the bolt circle is arranged concentrically around the aperture axis. This design makes the cost-effective and simple production possible as a result of the eccentric provision of the bearing bores relative to the compressor axis (i.e. concentrically to the aperture axis). Alternatively or additionally, the aperture elements can be rotatably mounted between a first position and a second position. Here, the aperture elements are mounted rotatably in a respective bearing bore. In particular, the aperture elements can be rotatably mounted between the first and the second position via in each case one bearing pin. This means the aperture elements can be rotatably mounted in the bearing bore via the bearing pin. In other words, this means that the bearing pins can be rotatably mounted in the respective bearing bore. The bearing pins can be formed integrally with the respective aperture element or connected fixedly (by e.g. welding, pressing, screwing, etc.) to it. Alternatively or additionally, the adjustment mechanism can release the inlet cross-section in the first position of the aperture elements, such that the maximum inlet cross-section is formed. Alternatively or additionally, the adjustment mechanism can reduce the inlet cross-section in the second position of the aperture elements, such that the reduced inlet cross-section is formed. Expressed alternatively, this means that the aperture elements can form the reduced inlet cross-section.

In designs of the compressor that can be combined with any of the previous designs, the adjustment mechanism can comprise an adjustment ring having several coupling recesses. The coupling recesses can be arranged peripherally along a coupling circuit in the adjustment ring. Here, the aperture elements can be coupled to the adjustment ring via one coupling element in each case, which engages in one coupling recess in each case.

In a first embodiment, the adjustment ring and the coupling circuit can be arranged around the aperture axis.

Alternatively to this, in a second embodiment, the adjustment ring can be arranged around the compressor axis and the coupling circuit around the aperture axis. Thus, the coupling circuit can be arranged offset to the coupling recesses within the adjustment ring R by the eccentricity E.

In designs of the compressor that can be combined with any of the previous designs, the compressor can furthermore comprise a compressor inlet connecting piece. The compressor inlet connecting piece can be arranged axially in front of the adjustment mechanism in the current direction. In addition, the compressor inlet connecting piece can form a main inlet channel with an inner diameter axially in front of the adjustment mechanism in the current direction. The main inlet channel or its inner diameter can define the maximum inlet cross-section.

In designs of the compressor, the adjustment mechanism can comprise a plurality of aperture elements which form the reduced inlet cross-section. In addition, the aperture elements can be shifted between a first position and a second position. In addition, the aperture elements can be formed in such a way that, in the second position, they can together form a circular cross-section border for the compressor inlet. Alternatively, the aperture elements can be formed in such a way that, in the second position, they together form an oval cross-section border for the compressor inlet. In addition, in the first position, the aperture elements can release the inlet cross-section, in particularly completely release it, such that the maximum inlet cross-section is present.

In designs of the compressor that can be combined with any of the previous designs, the adjustment mechanism can comprise a plurality of aperture elements, an adjustment ring and a bearing ring. Here, the aperture elements can be coupled to the adjustment ring in order to be moved between a first position and a second position by rotating the adjustment ring in order to change the inlet cross-section. In addition, each aperture element can comprise an aperture main body. Alternatively or additionally, each aperture element can comprise a bearing pin. Alternatively or additionally, each aperture element can comprise a coupling element. In each case, a coupling element of the aperture element can engage in the coupling recesses in order to transfer the rotational movement of the adjustment ring to a pivot movement of the respective aperture element. Alternatively or additionally, the adjustment mechanism can furthermore comprise an actuator device which is in effective connection with the adjustment ring or the adjustment mechanism in order to rotate the adjustment ring or in order to pivot the aperture element. Alternatively or additionally, the aperture elements can be in the first position of the adjustment mechanism, also in the first position and in the second position of the adjustment mechanism, also in the second position for changing the inlet cross-section between the maximum inlet cross-section and the reduced cross-section. Alternatively or additionally, radially internal side walls of the aperture element which define the inlet cross-section in the second position have a current-optimised geometry. Alternatively or additionally, the aperture elements can have corresponding engagement geometries on side walls abutting on one another in the second position, said engagement geometries overlapping with one another or engaging in one another in the second position of the aperture element.

Furthermore, the invention relates to a charging device. The charging device comprises a drive unit and a shaft. Furthermore, the charging device comprises a compressor according to any of the designs above. Here, the compressor wheel of the compressor is coupled to the drive unit via the shaft. The drive unit can comprise a turbine and/or an electric engine.

DETAILED DESCRIPTION

Figure 1:
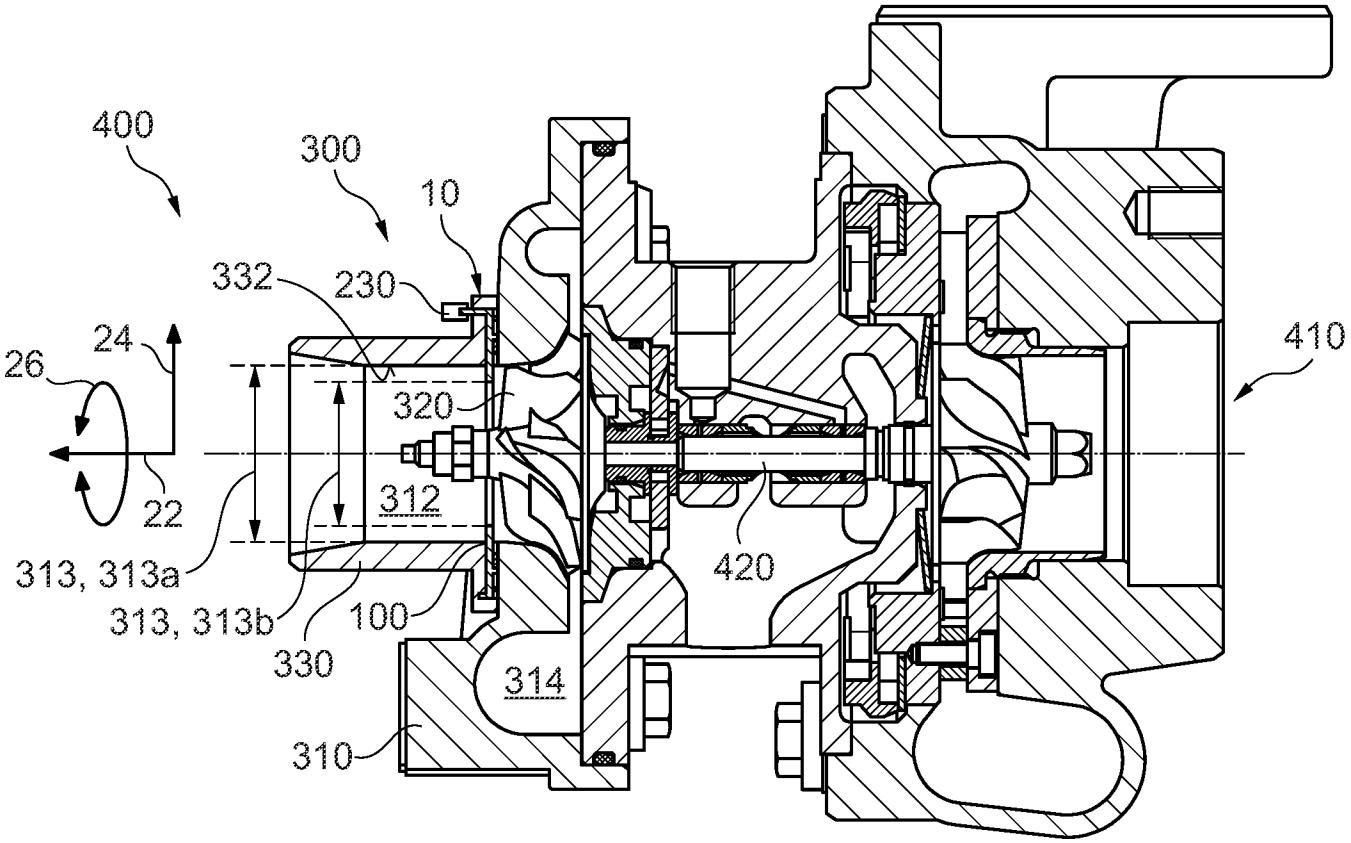
FIG. 1 shows a side sectional view of a compressor having an adjustment mechanism which is not arranged eccentrically.

In the context of this application, the expressions axially and axial direction relate to an axis of an adjustment mechanism 10 or to a rotation axis of a compressor 300 or to a compressor wheel 320. Here, distinction is made between a compressor axis 322 which runs along the rotation axis of the compressor wheel 320 (see e.g. FIGS. 1 and 2A) and an aperture axis 102 around which aperture elements 100 of the adjustment mechanism 10 (with the same radial spacing) are arranged (see e.g. FIGS. 2A and 5B). The respective axial direction of the compressor 300 or the aperture elements 100 is depicted with the reference numeral 22 or 22'. A radial direction 24 or 24' here refers to the compressor axis 322 or the aperture axis 102. Similarly, a peripheral direction 26 or 26' here relates to the compressor axis 322 or the aperture axis 102. Furthermore, the term downstream relates to a substantially axial direction 22, 22' or axial position in the direction of a compressor inlet connecting piece 330 to the compressor wheel 320, i.e. along the main current through the compressor 300 (see e.g. FIG. 1). The term upstream relates to a direction/position substantially opposite the downstream direction/position. Expressed differently, the terms downstream and upstream can be seen as substantially axial directions 22, 22', which, starting from the compressor inlet 312, are directed towards the compressor wheel 320 of the compressor 300 or away from it.

Figure 2A:
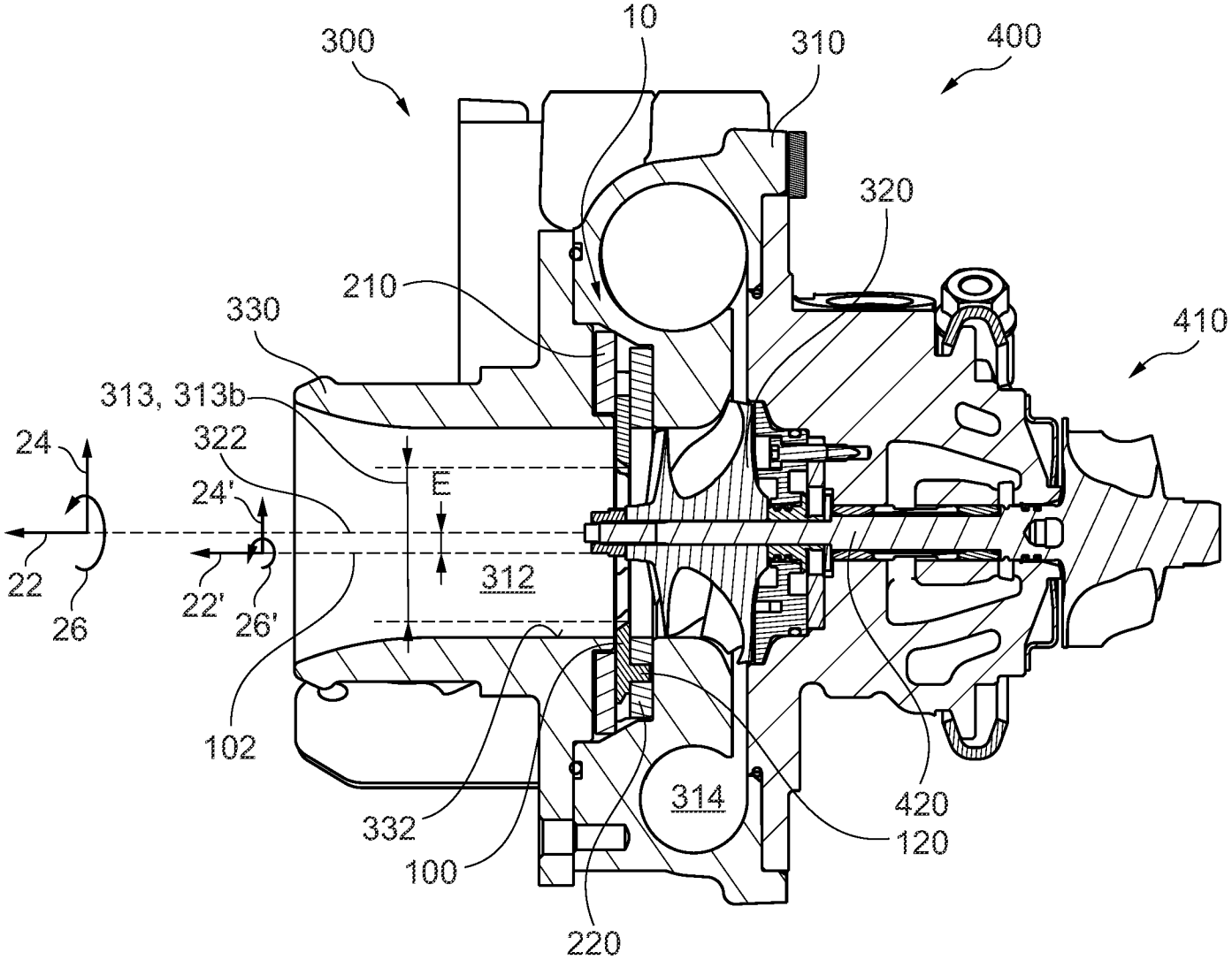
FIG. 2A shows a compressor according to the invention in a first embodiment having an adjustment mechanism in the second position with reduced inlet cross-section.

An exemplary charging device 400 is shown in FIG. 1. The charging device 400 comprises a drive unit 410, a shaft 420 and a compressor 300. The compressor 300 comprises a compressor housing 310, a compressor inlet 312 and a compressor outlet 314. The compressor 300 further comprises a compressor wheel 320 which is arranged in the compressor housing 310 between the compressor inlet 312 and the compressor outlet 314 and is rotatably mounted along the compressor axis 322. Here, the compressor wheel 320 is coupled to the drive unit 410 via the shaft 420. In the examples depicted, the drive unit 410 is formed as a turbine. During operation, the turbine is driven via exhaust gases of an internal combustion engine or a fuel cell. Alternatively or additionally, the drive unit 410 can also comprise an electric engine. The compressor inlet 312 defines an inlet cross-section 313 of the compressor 300. The region upstream in front of the compressor wheel 320 can here be seen as a compressor inlet 312. The inlet cross-section can thus be understood as a cross-sectional surface on a radial plane (i.e. a plane which is spanned by two (orthogonal) vectors in different radial directions 22) in the region of the compressor inlet 312 upstream of the compressor wheel 320.

Figure 2B:
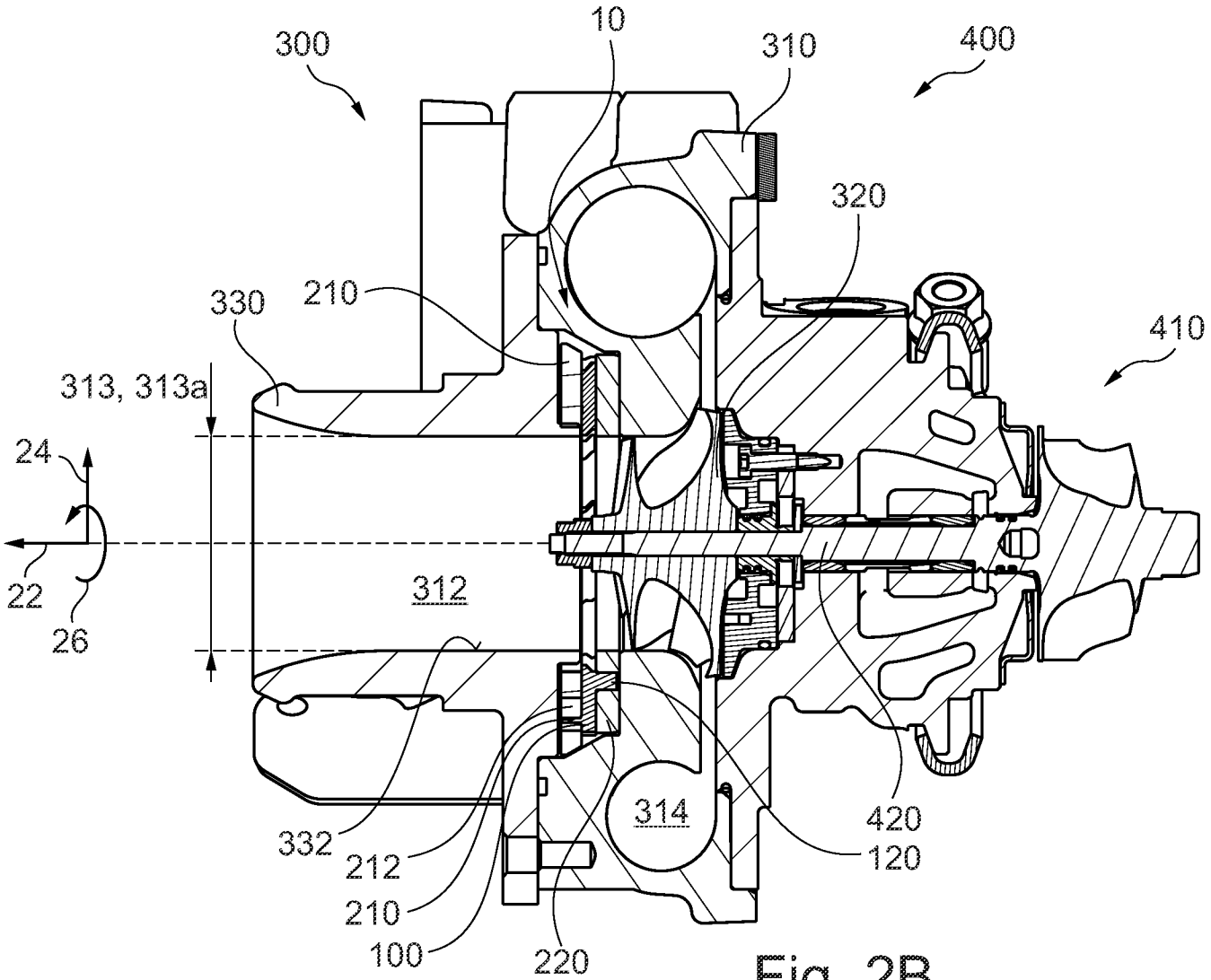
FIG. 2B shows a side sectional view of the compressor from FIG. 2A having the adjustment mechanism in the first position with the maximum inlet cross-section.

The compressor 300 further comprises an adjustment mechanism 10 which can be actuated, for example, by an actuator device 230. Alternatively, the adjustment mechanism 10 can also be formed in a self-regulating manner, for example. As can be seen easily in FIGS. 1 and 2A, the adjustment mechanism 10 is arranged in front of the compressor wheel 320 axially in the current direction. In other words, this means that the adjustment mechanism 10 is arranged in the compressor inlet 312 or in the region (at least in an axial region) of the compressor inlet 312. Here, the adjustment mechanism 10 is formed and arranged in such a way that it can be shifted between a first position and a second position to change the inlet cross-section 313. The adjustment mechanism 10 can here be shifted in such a way that the inlet cross-section 313 can be changed between a maximum inlet cross-section 313*a* and a reduced inlet cross-section 313*b*. The maximum inlet cross-section 313*a* is here defined by the compressor inlet 312. More accurately, the maximum inlet cross-section 313*a* is defined by a main inlet channel 332 in the compressor inlet 312 or by the radially inner dimensions of the main inlet channel 332 (e.g. an inner periphery/inner diameter of the main inlet channel 332). In the examples shown, the compressor 300 comprises a compressor inlet connecting piece 330 which, axially in the current direction in front of the adjustment mechanism 10, forms the main inlet channel 332 with the inner diameter which, in turn, defines the maximum inlet cross-section 313*a*. Here, the compressor inlet connecting point 330 is arranged in front of the adjustment mechanism 10 axially in the current direction. Alternatively or additionally, the main inlet channel 332 can also be formed by a part of the compressor housing 320 and/or by a part of the adjustment mechanism 10. The maximum inlet cross-section 313*a* can be reduced by means of corresponding actuation of the adjustment mechanism 10 from the first position into the second position. Here, the adjustment mechanism 10 (or corresponding aperture element 100 thereof) is moved from the first position into the second position, such that a reduced inlet cross-section 313*b* is present (see FIGS. 1 and 2A). This reduced inlet cross-section 313*b* is here formed or delimited by the adjustment mechanism 10. More accurately, the reduced inlet cross-section 313*b* is formed by the aperture element 100. In the first position of the adjustment mechanism 10, in contrast, the maximum inlet cross-section 313*a* is present (see FIG. 2B).

FIG. 1 shows an adjustment mechanism 10 which forms a reduced inlet cross-section 313*b* arranged concentrically in relation to the compressor axis 322.

In contrast, the present invention according to FIGS. 2A to 5B shows an adjustment mechanism 10 which forms the reduced inlet cross-section 313*b* in such a way that the reduced inlet cross-section 313*b* is arranged eccentrically in relation to the compressor axis 322. For this reason, all details explained with reference to FIG. 1 except for the exact design of the adjustment mechanism 10 can be transferred to the designs according to the invention of FIGS. 2A to 5B in obtain an eccentric reduced inlet cross-section 313*b*. In particular in FIG. 3, it can be easily seen how the eccentrically arranged reduced inlet cross-section 313*b* (here depicted hatched) is formed by the aperture elements 100. As a result of the eccentric arrangement of the reduced inlet cross-section 313*b*, current vortices emerging between the adjustment mechanism 10 or the aperture elements 100 and the compressor wheel 320 can interact eccentrically with the compressor wheel on a rear side (in the current direction/downstream) or an inner edge (radially inner edge) of the adjustment mechanism 10 or its aperture elements 100. The eccentricity changes the strength and the detachment frequency of the current vortices in the peripheral direction 26' and influences the frequency spectrum in a favourable manner. Thus, a more broadband noise development can be generated which can be perceived less intensively. As a result, the NVH behaviour can thus be improved.

Figure 5B:
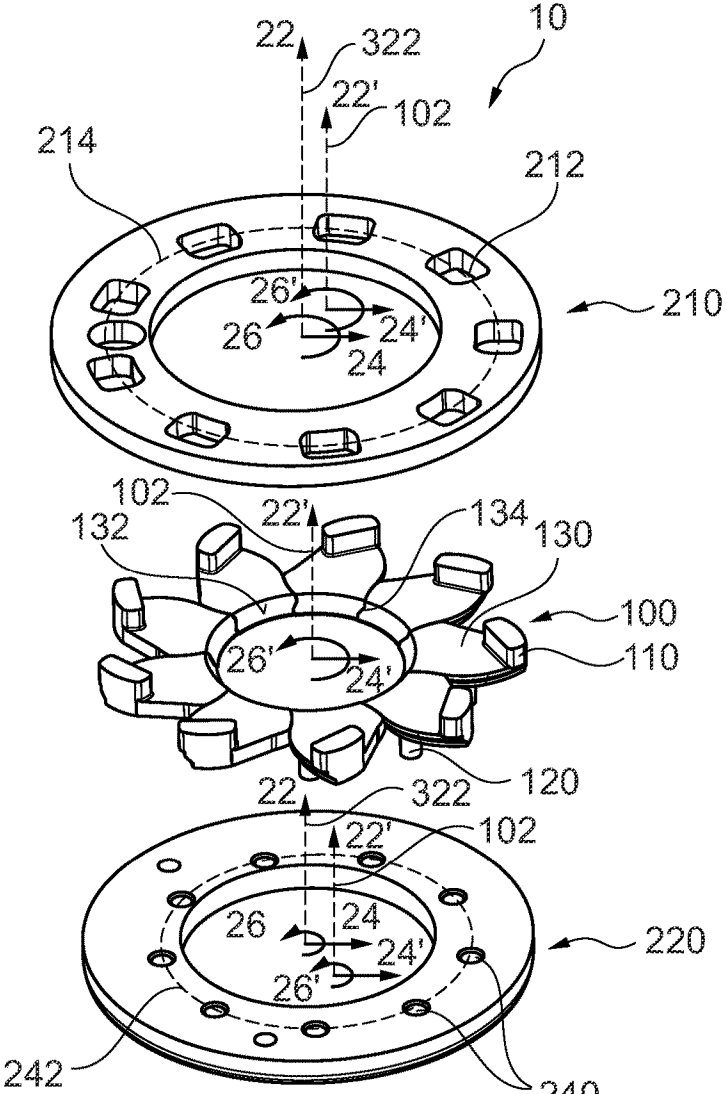
FIG. 5B shows an exploded depiction of an adjustment mechanism of the compressor of the second embodiment in the current direction without compressor inlet connecting pieces.
Figure 5A:
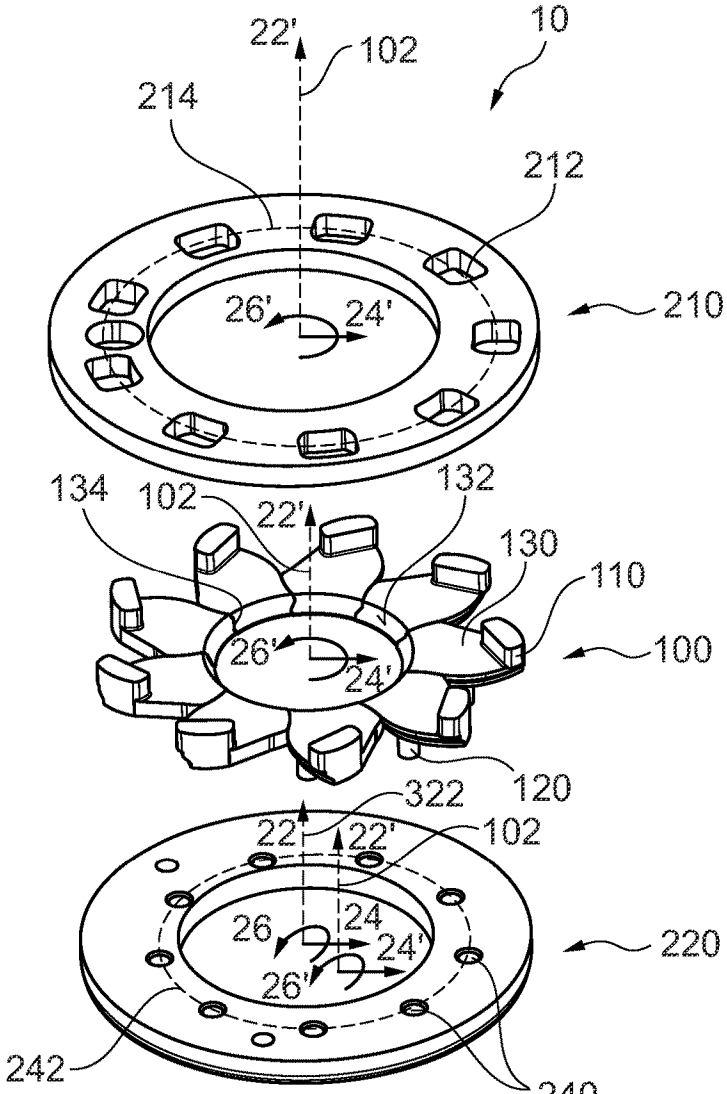
FIG. 5A shows an exploded depiction of an adjustment mechanism of the compressor of the first embodiment in the current direction without compressor inlet connecting pieces.

As can be seen in FIGS. 2A, 2B, 5A and 5B, in particular, the adjustment mechanism 10 comprises a plurality of aperture elements 100. The aperture elements 100 each comprise an aperture main body 130, a coupling element 110 and a bearing pin 120. The aperture elements 100 can be adjusted between a first position, which corresponds to the first position of the adjustment mechanism 10, and a second position, which corresponds to the second position of the adjustment mechanism 10. Thus, the aperture elements 100 or their aperture main body 130 form or delimit the reduced inlet cross-section 313*b* (see FIG. 3). The aperture elements 100 are arranged spaced apart from the compressor axis 322 by an eccentricity E in the peripheral direction 26' around an aperture axis 102. More accurately, the aperture axis 102 is spaced apart from the compressor axis 322 by the eccentricity E in the radial direction 22. Here, it can be noted that FIGS. 5A and 5B show only schematic depictions, wherein it should be understood that the aperture axis 102 is spaced apart from the compressor axis 322 by the eccentricity E in all designs according to the invention. This can clearly be seen in at least FIGS. 2A, 2B and 3. The absolute value of the eccentricity E is here dependent on a maximum possible eccentricity $E_{max}$. In the examples depicted, the eccentricity is 100% of the maximum possible eccentricity $E_{max}$. In alternative designs, the eccentricity E can assume a value of between 1% and 100%, preferably between 25% and 95% and particularly preferably between 50% and 90% of the maximum possible eccentricity $E_{max}$. The maximum possible eccentricity $E_{max}$ is here caused by the construction and can be determined by a difference from the radius of a radially inner aperture periphery in the first position of the aperture elements 100 (see depicted first position of the aperture elements in FIG. 2B) and the radius of a radially inner aperture periphery in the second position of the aperture elements 100 (see depicted second position of the aperture elements in FIG. 2A). In other words, the aperture axis 102 can be spaced apart from the compressor axis 322 maximally by a spacing (i.e. the maximum possible eccentricity $E_{max}$), such that the aperture elements 100 in the first position no longer reduce the maximum inlet cross-section 313*a*, i.e. such that each aperture element 100 in the first position is at last radially outside the compressor inlet 312. The eccentric arrangement of the aperture elements 100 can thus lead to a reduced inlet cross-section 313*b* arranged eccentrically in relation to the compressor axis 322 with the advantageous technical effects described above. This means the reduced inlet cross-section 313*b* is arranged spaced apart from the compressor axis 322 by the eccentricity E.

Figure 4A:
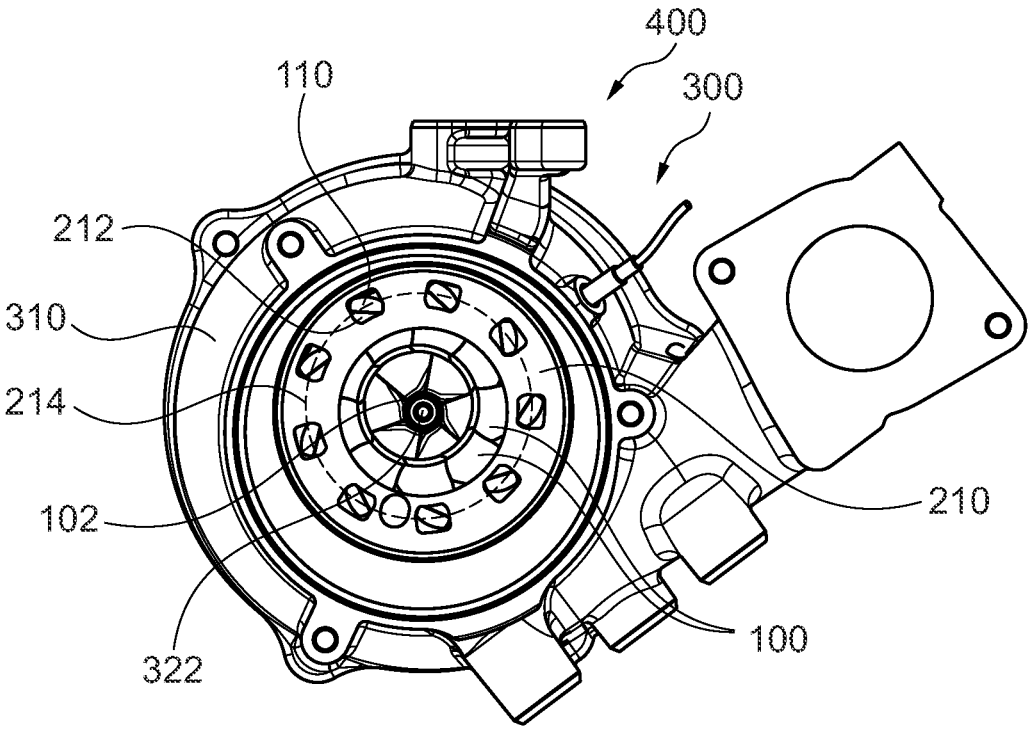
FIG. 4A shows a top view of the compressor of the first embodiment in the current direction without compressor inlet connecting pieces.
Figure 4B:
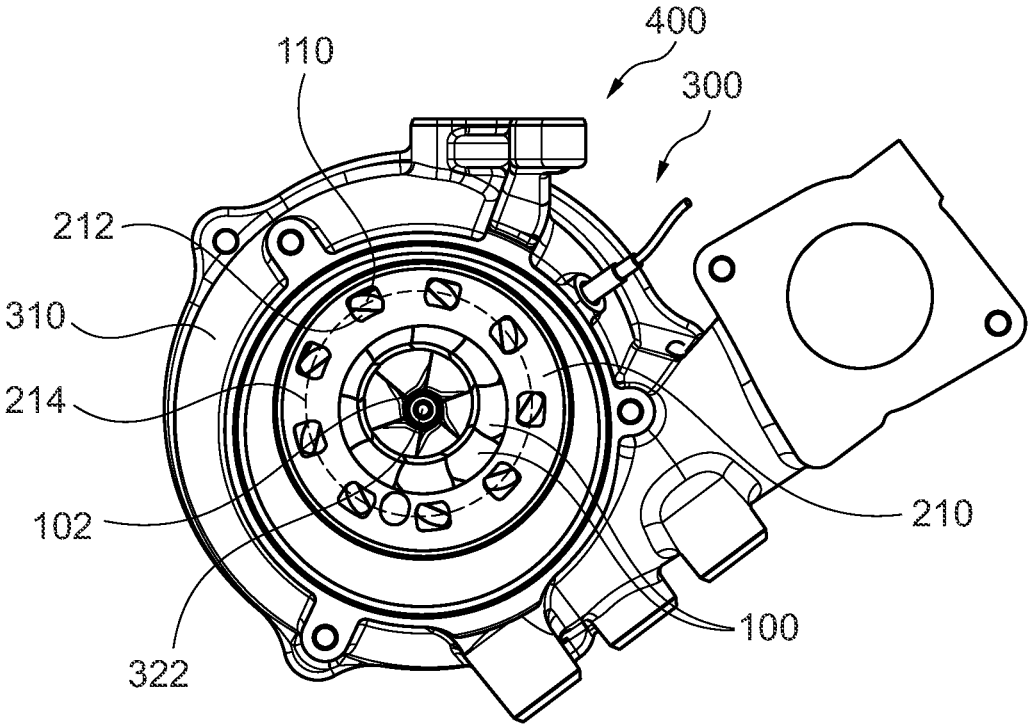
FIG. 4B shows a top view of the compressor of the second embodiment in the current direction without compressor inlet connecting pieces.

Along with the aperture elements 100, the adjustment mechanism 10 further comprises an adjustment ring 210 and a bearing ring 220 (see FIGS. 2A, 2B, 5A and 5B). The aperture elements 100 are here coupled to the adjustment ring 210 in order to be moved between a first position and a second position. For this, the adjustment ring 210 comprises several coupling recesses 212. The coupling recesses 212 are arranged peripherally along a coupling circuit 214 in the adjustment ring 210. The aperture elements 100 are coupled to the adjustment ring 210 via a respective coupling element 110 which respectively engages in a coupling recess 212. Thus, the aperture elements 100 can be moved by a rotation of the adjustment ring 210 between the first position and the second position in order to change the inlet cross-section 313. Here, each aperture element 100 or its respective aperture main body 130 is pivoted radially inwards in the compressor inlet 312 in order to generate the reduced inlet cross-section 313*b*. In this respect, two different embodiments are explained below, wherein FIGS. 4A and 5A show a first embodiment, and FIGS. 4B and 5B show a second embodiment.

According to the first embodiment, the adjustment ring 210 is arranged centrally (i.e. concentrically) around the aperture axis 102. The coupling circuit 214 is also arranged (concentrically) around the aperture axis 102 in the installed state. This is shown in FIG. 4A, which substantially corresponds to FIG. 3, yet in which the compressor inlet connecting piece 330 is not depicted, such that the adjustment ring 210 with the coupling recesses 212 along the coupling circuit 214 can be seen. When seen in relation to the adjustment ring 210, the coupling recesses 212 or the coupling circuit 214 are spaced apart with the same spacing from a radially inner periphery of the adjustment ring 210 (see FIG. 5A).

In comparison to this, the adjustment ring 210 according to the second embodiment is arranged centrally (i.e. concentrically) around the compressor axis 322. The coupling circuit 214 is here arranged (concentrically) around the aperture axis 102 in the installed state. This is shown in FIG. 4B which substantially corresponds to FIG. 3, yet in which the compressor inlet connecting piece 330 is not depicted, such that the adjustment ring 210 with the coupling recesses 212 along the coupling circuit 214 can be seen. Thus, the coupling circuit 214 with the coupling recesses 212 is arranged offset by the eccentricity E inside the adjustment ring 210. This means, when seen in relation to the adjustment ring 210, the coupling recesses 212 or the coupling circuit 214 are spaced apart from a radially inner periphery of the adjustment ring 210 at different spacings (see FIG. 5B).

As already mentioned, the aperture elements 100 each comprise a bearing pin 120 via which the aperture elements 100 are rotationally mounted. The bearing pin 120 is fixedly connected to the respective aperture element 100 and arranged on a first axial side of the aperture main body 130. The coupling element 110 is arranged on a second axial side of the aperture main body 130 which is opposite the first axial side. This is also fixedly connected to the respective aperture main body 130. A bearing bore 240 is provided in each case in the bearing ring 220 for each aperture element 100 (see FIGS. 5A and 5B). The bearing bores 240 are arranged along a bore circuit 242. Here, the bore circuit 242 is arranged around the aperture axis 102. In other words, this means that the bore circuit 242 is arranged concentrically around the aperture axis 102. Expressed differently, the bore circuit is arranged eccentrically by the eccentricity E from the compressor axis 322. This means that the aperture elements 100 are rotationally mounted eccentrically in relation to the compressor axis 322 along the bore circuit 242. This design makes a cost-effective and simple production possible as a result of the eccentric provision of the bearing bores 240 in relation to the compressor axis 322 (i.e. concentrically to the aperture axis 102). Thus, the aperture elements 100 are mounted rotationally in the bearing ring 220 via their bearing pins 120. The rotation axis of the aperture elements 100 runs in the axial direction 22, 22'. In alternative designs, the bearing bores 240 can also analogously be provided directly in the compressor housing 310. In such a design, a bearing ring 220 is not required. Thus, the aperture elements 100 are rotatably mounted between the first position and the second position respectively via a bearing pin 120. Here, the aperture elements 100 are mounted rotatably in the respective bearing bore 240. This means the aperture elements 100 are rotatably mounted in the respective bearing bore 240 via the respective bearing pin 120. In other words, this means that the bearing pins 120 are mounted rotatably in the respective mounting bore 240. The bearing pins 120 can be formed integrally with the respective aperture element or, as already mentioned, can be fixedly (by means of e.g. welding, pressing, screwing, etc.) connected to it or the aperture main body 130. This also applies analogously to the coupling elements 110. As a result of the mounting of the aperture elements 100 in the bearing bores 240 along the bore circuit 242 arranged eccentrically in relation to the compressor axis 322, the eccentric arrangement of the aperture elements 100 and thus the eccentric arrangement of the reduced inlet cross-section 313*b* can be obtained. Furthermore, as a result of the mounting, the rotational movement of the adjustment ring 210 can be transferred into a pivoting movement of the respective aperture elements 100.

Figure 3:
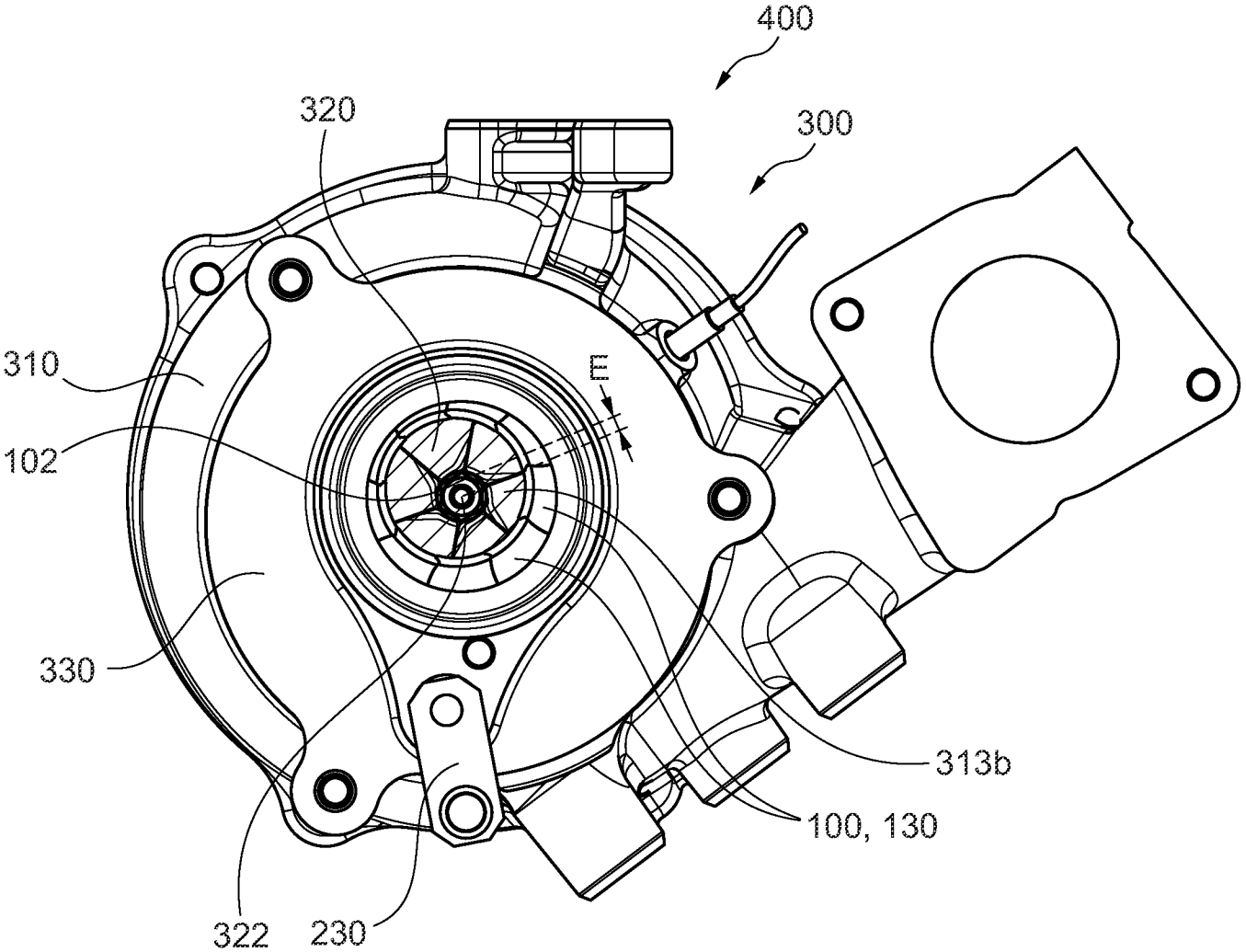
FIG. 3 shows a top view of the compressor in the current direction having compressor inlet connecting pieces.

As shown in FIGS. 1 and 3, the actuator device 230 of the adjustment mechanism 10 can be in effective connection with the adjustment ring 210 or directly with the at least one aperture element 100 in order to rotate the adjustment ring 210 or in order to pivot the aperture elements 100.

The adjustment mechanism 10 can release the inlet cross-section 313 in the first position of the aperture elements 100, such that the maximum inlet cross-section 313*a* is present. Here, the aperture elements 100 or their aperture main bodies 130 are pivoted radially outwardly from the compressor inlet 312 (see e.g. FIG. 2B). This means the aperture elements 100 completely release the inlet cross-section 313 in the first position, such that the maximum inlet cross-section 313*a* is present. In the second position of the aperture elements 100, the adjustment mechanism 10 can reduce the inlet cross-section 313, such that the reduced inlet cross-section 313*b* is formed. The aperture elements 100 are here formed in such a way that, in the second position, they together form a circular cross-section limit for the compressor inlet 312 (see e.g. FIG. 3). This means the aperture elements 100, in the second position, collectively form a circular cross-section limit, which leads to the reduced inlet cross-section 313*b*. In the figures depicted, the second position corresponds to the position in which the inlet cross-section 313 is maximally reduced and the aperture elements 100 abut on one another in the peripheral direction 26'. Here, it should be noted that intermediary positions between the first and second positions of the aperture elements 100 or the adjustment elements 10 described here can be set which, because of the arrangement and design of the adjustment mechanism 10, also lead to a reduced inlet cross-section 313*b* arranged eccentrically in relation to the compressor axis 322. In such a case, the second position can be an intermediary position, for example, and a third position can be the position in which the inlet cross-section 313 is maximally reduced. Analogously, a plurality of intermediary positions are possible. Alternatively to the circular cross-sectional limit, the aperture elements 100 can also be designed in such a way that they together form an oval cross-section limit for the compressor inlet 312 in the second position (or third position).

As can be seen in FIGS. 5A and 5B in particular, radially inner side walls 132 of the aperture elements 100, which define the reduced inlet cross-section 313*b* in the second position, can have a current-optimised geometry. In FIGS. 5A and 5B, this current-optimised geometry is formed, for example, as a side wall 132 running conically in the current direction. Alternatively, the side walls can be formed conically curved in opposition to the current direction (concave/convex) or as rounded edges etc. Furthermore, the aperture elements 100 can have corresponding engagement geometries 134 on side surfaces abutting on one another in the second position (for example steps, V-shaped, protrusion/indentation, sealing element, etc.), which overlap with or engage in one another in the second position of the aperture elements 100. Thus, a better sealing between the aperture elements 100 can be obtained.

The adjustment mechanisms 10 described here are those which, in the first position, are radially outside the compressor inlet 312 or the main inlet channel 332. In the second position, the adjustment mechanism 10 or its aperture elements is or are pivoted radially inwardly into the compressor inlet 312, wherein the aperture elements 100 can rotated around a rotation axis which runs in the axial direction 22, 22'. Analogously, it should be understood that this invention also comprises other kinds of adjustment mechanisms/current modification device which, in a second position, generate a reduced inlet cross-section which is arranged eccentrically in relation to the compressor axis in order to obtain the same advantageous technical effects. These other adjustment mechanisms can comprise, for example, pivotable aperture elements (around a radial axis), lamella-like trimming elements with a funnel-shaped cross-sectional limit, for example, axially shiftable sleeves, radially moveably or extendable wall elements.

| List of reference numerals | |
|---|---|
| 10 | Adjustment mechanism |
| E | Eccentricity |
| 22, 22' | Axial direction |
| 24, 24' | Radial direction |
| 26, 26' | Peripheral direction |
| 100 | Aperture elements |
| 102 | Aperture axis |
| 110 | Coupling element |
| 120 | Bearing pin |
| 130 | Aperture main body |
| 132 | Side walls |
| 134 | Engagement geometries |
| 210 | Adjustment ring |
| 212 | Coupling recesses |
| 214 | Coupling circuit |
| 220 | Bearing ring |
| 230 | Actuator device |
| 240 | Bearing bores |
| 242 | Bore circuit |
| 300 | Compressor |
| 310 | Compressor housing |
| 312 | Compressor inlet |
| 313 | Inlet cross-section |
| 313a | Maximum inlet cross-section |
| 313b | Minimum inlet cross-section |
| 314 | Compressor outlet |
| 320 | Compressor wheel |
| 322 | Compressor axis |
| 330 | Compressor inlet connecting piece |
| 332 | Main inlet channel |
| 400 | Charging device |
| 410 | Drive unit |
| 420 | Shaft |

Although the present invention has been described above and is defined in the attached claims, it should be understood that the invention can also alternatively be defined according to the following embodiments:

1. Compressor (300) for a charging device (400), comprising:
   - a compressor housing (310) having a compressor inlet (312) and a compressor outlet (314),
   - a compressor wheel (320) which is arranged in the compressor housing (310) and can be rotated along a compressor axis (322), and
   - an adjustment mechanism (10) which is arranged in front of the compressor wheel (320) axially in the current direction, wherein the adjustment mechanism (10) can be adjusted between a first position and a second position in order to change an inlet cross-section (313) of the compressor inlet (312), such that the inlet cross-section (313) can change between a maximum inlet cross-section (313*a*) and a reduced inlet cross-section (313*b*), wherein the adjustment mechanism (10) forms the reduced inlet cross-section (313*b*), characterised in that the reduced inlet cross-section (313*b*) is arranged eccentrically in relation to the compressor axis (322).

2. Compressor (300) according to embodiment 1, wherein the adjustment mechanism (10) comprises a plurality of aperture elements (100) which are arranged around an aperture axis (102) in the peripheral direction (26'), wherein the aperture axis (102) is spaced apart from the compressor axis (322) by an eccentricity (E).
3. Compressor (300) according to embodiment 2, wherein the eccentricity (E) assumes a value of between 1% and 100%, preferably between 25% and 95% and particularly preferably between 50% and 90% of a maximum possible eccentricity ($E_{max}$).
4. Compressor (300) according to any one of embodiments 2 or 3, wherein, for each aperture element (100), in each case one bearing bore (240) is provided in the compressor housing (310) or in a bearing ring (220), wherein the bearing bores (240) are arranged along a bore circuit (242) around the aperture axis (102).
5. Compressor (300) according to any one of embodiments 2 to 4, wherein the aperture elements (100) are rotatably mounted between a first position and a second position, preferably in each case via a bearing pin (120).
6. Compressor (200) according to embodiment 5, wherein the adjustment mechanism (10) releases the inlet cross-section (313) in the first position of the aperture elements (100), such that the maximum inlet cross-section (313*a*) is formed, and reduces in the second position of the aperture elements (100), such that the reduced inlet cross-section (313*b*) is formed.
7. Compressor (300) according to any one of embodiments 2 to 6, wherein the adjustment mechanism (10) comprises an adjustment ring (210) having several coupling recesses (212) which are arranged in the adjustment ring (210) peripherally along a coupling circuit (214), wherein the aperture elements (100) are coupled to the adjustment ring (210) in each case via a coupling element (110) which respectively engages in a coupling recess (212).
8. Compressor (200) according to embodiment 7, wherein the adjustment ring (210) and the coupling circuit (214) are arranged around the aperture axis (102).
9. Compressor (200) according to embodiment 7, wherein the adjustment ring (210) is arranged around the compressor axis (322) and the coupling circuit (214) is arranged around the aperture axis (102), such that the coupling circuit (214) is arranged offset to the coupling recesses (212) by the eccentricity (E) inside the adjustment ring (210).
10. Compressor (300) according to any one of embodiments 2 to 9, wherein the aperture elements (100) form the reduced inlet cross-section (313*b*).
11. Compressor (300) according to any one of the preceding embodiments, further comprising a compressor inlet connecting piece (330), which is arranged in front of the adjustment mechanism (10) axially in the current direction, in particular, wherein the compressor inlet connecting piece (330) forms a main inlet channel (332) with an inner diameter in front of the adjustment mechanism (10) axially in the current direction, said inner diameter defining the maximum inlet cross-section (313*a*).
12. Compressor (300) according to embodiment 1, wherein the adjustment mechanism (10) comprises a plurality of aperture elements (100) which form the reduced inlet cross-section (313*b*).
13. Compressor (300) according to embodiment 12, wherein the aperture elements (100) can be adjusted between a first position and a second position, in particular wherein the aperture elements (100) are formed in such a way that, in the second position, they together form a circular or oval cross-section limit for the compressor inlet (110).
14. Compressor (300) according to embodiment 13, wherein, in the first position, the aperture elements (100) release, in particular completely release, the inlet cross-section (313), such that the maximum inlet cross-section (313*a*) is present.
15. Compressor (300) according to any one of the preceding embodiments, wherein the adjustment mechanism (10) comprises a plurality of aperture elements (100), an adjustment ring (210), and
    a bearing ring (220), wherein the aperture elements (100) are coupled to the adjustment ring (210) in order to be moved by rotating the adjustment ring (210) between a first position and a second positions in order to change the inlet cross-section (313).
16. Compressor (300) according to embodiment 15, wherein each aperture element (100) comprises an aperture main body (130), a bearing pin (120) and a coupling element (110).
17. Compressor (300) according to embodiment 16, wherein the adjustment ring (210) comprises several coupling recesses (212) into which a coupling element (110) of an aperture element (100) respectively engages, in order to transfer a rotational movement of the adjustment ring (210) into a pivot movement of the respective aperture elements (100).
18. Compressor (300) according to any one of embodiments 15 to 17, further comprising an actuator device (230) which is in effective connection with the adjustment ring (210) or the adjustment mechanism (10), in order to rotate the adjustment ring (210) or in order to pivot the aperture elements (100).
19. Compressor (300) according to any of embodiments 15 to 18, wherein the aperture elements (100) in the first position of the adjustment mechanism (10) are also in the first position and, in the second position of the adjustment mechanism (10), are also in the second position in order to change the inlet cross-section (313) between the maximum inlet cross-section (313*a*) and the reduced inlet cross-section (313*b*).
20. Compressor (300) according to any one of embodiments 15 to 19, wherein radially internal side walls (132) of the aperture elements (100) which, in the second position, define the inlet cross-section (313), have a current-optimised geometry.
21. Compressor (300) according to any one of embodiments 15 to 20, wherein the aperture elements (100) have corresponding engagement geometries (134) on side surfaces adjacent to one another in the second position, which, in the second position of the aperture elements (100), overlap with one another or engage in one another.
22. Charging device (400), comprising:
    a drive unit (410) and a shaft (420),
    characterised by a compressor (300) according to any one of the preceding embodiments, wherein the compressor wheel (320) of the compressor (300) is coupled to the drive unit (410) via the shaft (420).
23. Charging device (400) according to embodiment 22, wherein the drive unit (410) comprises a turbine and/or an electric engine.

The invention claimed is:

1. A compressor (300) for a charging device (400), comprising:
    a compressor housing (310) having a compressor inlet (312) and a compressor outlet (314), a compressor wheel (320) which is arranged in the compressor housing (310) and can be rotated along a compressor axis (322), and an adjustment mechanism (10) which is arranged in front of the compressor wheel (320) axially in a current direction, wherein the adjustment mechanism (10) can be adjusted between a first position and a second position in order to change an inlet cross-section (313) of the compressor inlet (312), such that the inlet cross-section (313) can change between a maximum inlet cross-section (313*a*) and a reduced inlet cross-section (313*b*), wherein the adjustment mechanism (10) forms the reduced inlet cross-section (313*b*), characterised in that the reduced inlet cross-section (313*b*) is arranged eccentrically in relation to the compressor axis (322) and wherein the adjustment mechanism (10) comprises a plurality of aperture elements (100) which are arranged around an aperture axis (102) in a peripheral direction (26'), wherein the aperture axis (102) is spaced apart from the compressor axis (322) by an eccentricity (E), and optionally wherein the plurality of aperture elements (100) form the reduced inlet cross-section (313*b*).

2. The compressor (300) according to claim 1, wherein the eccentricity (E) assumes a value of between 1% and 100% of a maximum possible eccentricity ($E_{max}$).

3. The compressor (300) according to claim 2, wherein the eccentricity (E) assumes a value of between 25% and 95% of the maximum possible eccentricity ($E_{max}$).

4. The compressor (300) according to claim 2, wherein the eccentricity (E) assumes a value of between 50% and 90% of the maximum possible eccentricity ($E_{max}$).

5. The compressor (300) according to claim 1, wherein, for each of the plurality of aperture elements (100), in each case one bearing bore (240) is provided in the compressor housing (310) or in a bearing ring (220), wherein each bearing bore (240) is arranged along a bore circuit (242) around the aperture axis (102).

6. The compressor (300) according to claim 1, wherein the plurality of aperture elements (100) are rotatably mounted between a first position and a second position, and optionally wherein the adjustment mechanism (10) releases the inlet cross-section (313) in the first position of the plurality of aperture elements (100), such that the maximum inlet cross-section (313*a*) is formed, and reduces in the second position of the plurality of aperture elements (100), such that the reduced inlet cross-section (313*b*) is formed.

7. The compressor (300) according to claim 6, wherein each of the plurality of aperture elements (100) are rotatably mounted between the first position and the second position via a bearing pin (120).

8. The compressor (300) according to claim 1, wherein the adjustment mechanism (10) comprises an adjustment ring (210) having several coupling recesses (212) which are arranged in the adjustment ring (210) peripherally around a coupling circuit (214), wherein the plurality of aperture elements (100) are coupled to the adjustment ring (210) in each case via a coupling element (110) which respectively engages in a respective one of the several coupling recesses (212).

9. The compressor (200) according to claim 8, wherein the adjustment ring (210) and the coupling circuit (214) are arranged around the aperture axis (102).

10. The compressor (200) according to claim 8, wherein the adjustment ring (210) is arranged around the compressor axis (322) and the coupling circuit (214) is arranged around the aperture axis (102), such that the coupling circuit (214) is arranged offset to the several coupling recesses (212) by the eccentricity (E) inside the adjustment ring (210).

11. The compressor (300) according to claim 1, further comprising a compressor inlet connecting piece (330), which is arranged in front of the adjustment mechanism (10) axially in the current direction.

12. The compressor (300) according to claim 11, wherein the compressor inlet connecting piece (330) forms a main inlet channel (332) with an inner diameter in front of the adjustment mechanism (10) axially in the current direction, said inner diameter defining the maximum inlet cross-section (313*a*).

13. The compressor (300) according to claim 1, wherein the plurality of aperture elements (100) form the reduced inlet cross-section (313*b*).

14. The compressor (300) according to claim 13, wherein the plurality of aperture elements (100) can be adjusted between a first position and a second position.

15. The compressor (300) according to claim 14, wherein, in the first position, the plurality of aperture elements (100) release the inlet cross-section (313), such that the maximum inlet cross-section (313*a*) is present.

16. The compressor (300) according to claim 15, wherein, in the first position, the plurality of aperture elements (100) completely release the inlet cross-section (313).

17. The compressor (300) according to claim 14, wherein the plurality of aperture elements (100), in the first position of the adjustment mechanism (10) are also in the first position and, in the second position of the adjustment mechanism (10), are also in the second position in order to change the inlet cross-section (313) between the maximum inlet cross-section (313*a*) and the reduced inlet cross-section (313*b*).

18. The compressor (300) according to claim 14, wherein the plurality of aperture elements (100) are formed in such a way that, in the second position, they together form a circular or oval cross-section limit for the compressor inlet (110).

19. The compressor (300) according to claim 13, wherein each of the plurality of aperture elements (100) comprises an aperture main body (130), a bearing pin (120) and a coupling element (110).

20. The charging device (400), comprising:

a drive unit (410) and a shaft (420), characterised by the compressor (300) according to claim 1, wherein the compressor wheel (320) of the compressor (300) is coupled to the drive unit (410) via the shaft (420), and optionally wherein the drive unit (410) comprises a turbine and/or an electric engine.

* * * * *